United States Patent [19]

Boisture et al.

[11] Patent Number: 5,018,544

[45] Date of Patent: May 28, 1991

[54] APPARATUS FOR CLEANING HEAT EXCHANGER TUBE BUNDLES

[75] Inventors: Thomas B. Boisture, Baytown; Larry D. McGrew, Cleveland; James D. Jeffrey, Baytown; Robert G. Wetzel, Humble, all of Tex.; Gene P. Livingston, Pleasant Hill, Calif.; Robert A. Baten, Houston, Tex.

[73] Assignee: Ohmstede Mechanical Services, Inc., Baytown, Tex.

[21] Appl. No.: 489,001

[22] Filed: Mar. 6, 1990

[51] Int. Cl.[5] ..... B08B 3/02

[52] U.S. Cl. ..... 134/111; 134/144; 134/157; 134/181

[58] Field of Search ..... 134/111, 140, 141, 144, 134/153, 157, 159, 172, 180, 181

[56] References Cited

U.S. PATENT DOCUMENTS

| | | | |
|---|---|---|---|
| 2,685,293 | 8/1954 | Dauphinee et al. | 134/153 |
| 3,052,245 | 9/1962 | Nagle | 134/144 |
| 3,060,064 | 10/1962 | Zingg | 134/144 X |
| 3,074,649 | 1/1963 | Atkinson | 239/165 |
| 3,074,822 | 1/1963 | Walk et al. | 134/7 |
| 3,098,349 | 7/1963 | Waninger | 59/78.1 |
| 3,153,510 | 10/1964 | Brannfors | 239/165 X |
| 3,163,880 | 1/1965 | Johnson | 239/165 X |
| 3,225,777 | 12/1965 | Shelton et al. | 134/141 |
| 3,380,658 | 4/1968 | Stasz et al. | 239/130 |
| 3,675,721 | 7/1972 | Davidson et al. | 239/165 X |
| 3,703,905 | 11/1972 | Ice, Jr. | 134/144 |
| 3,716,986 | 2/1973 | Cork et al. | 59/78.1 |
| 3,921,388 | 11/1975 | Loos et al. | 59/78.1 |
| 4,170,264 | 10/1979 | Gibson | 239/165 X |
| 4,199,837 | 4/1980 | Fisco, Jr. | 15/302 |
| 4,201,342 | 5/1980 | Stram | 239/165 X |
| 4,220,170 | 9/1980 | Hebert et al. | 134/167 R |
| 4,234,980 | 11/1980 | Divito et mal. | 15/302 |
| 4,252,274 | 2/1981 | Kubacak | 239/163 |
| 4,322,868 | 4/1982 | Wurster | 15/302 |
| 4,509,544 | 4/1985 | Mains, Jr. | 134/144 |
| 4,600,817 | 7/1986 | Hackenberg | 59/78.1 X |
| 4,805,653 | 2/1989 | Krajicek et al. | 134/166 C |

FOREIGN PATENT DOCUMENTS 52-36865 3/1977 Japan .

OTHER PUBLICATIONS

Weatherford Water Jetting System, Weatherford Brochure, 1988, "Shell-Side Tube Cleaner is Speedy and Safe", 6/5/78, Chemical Engineering, p. 97.

Hiab Crane Brochure Illustrating the Specification of the Hiab 071; Hiab Cranes & Headers, Inc.; date unknown.

The Broadbent Services, Broadbent, Inc., date unknown.

The Cesco Scene, Cesco, Inc., Newsletter, date and author unknown.

Cesco, Inc., Newsletter, date and author unknown.

Browning-Ferris Industries Chemical Services, Inc., pp. RC-1007-1008; date and author unknown.

Cesco, Inc., 1971, Annual Report, pp. 8-9.

Photographs of Cesco, Inc., Hydroblast Trucks (date unknown).

Hydrovac International, Ltd., Sales Brochure, date unknown.

"High Pressure Water Jetting Techniques", Apr. 1982, Corrosion Prevention and Control.

R. Gatewood, "Heat Exchanger Reliability", Canadian Nuclear Association, 1980.

"State of the Art Mechanical Cleaning of Heat Exchangers", Robert Lee, Oct. 20-24/85, pp. 1-10.

"Refinery Cleaning Overview", S. Ron Rials, Apr. 2-6, 1984, Corrosion, 84, pp. 1/1-1/14.

"High Pressure Water Jetting Techniques", J. W. Twigg, Corrosion Prevention & Control, vol. 29, No. 2 (date unknown).

*Primary Examiner*—Philip R. Coe

*Attorney, Agent, or Firm*—Pravel, Gambrell, Hewitt, Kimball, Krieger

[57] ABSTRACT

A mobile tube bundle cleaning apparatus comprised of a truck mounted fluid and hydraulic pressure sources including high pressure pumps and diesel engines. The apparatus further includes a trailer mounted tube bundle cleaning system including an articulable mobile crane, outriggers for stabilizing the trailer during cleaning operations and a system for supporting and rotating a tube bundle during cleaning operations. The apparatus further includes a remote control pedestal from which an operator may control the fluid pressurizing system, the crane and the operation of the tube bundle rotating system.

14 Claims, 5 Drawing Sheets

APPARATUS FOR CLEANING HEAT EXCHANGER TUBE BUNDLES

BACKGROUND OF THE INVENTION

1. Field of the Invention

This invention relates to an apparatus for cleaning heat exchanger tube bundles. More particularly, this invention relates to an apparatus for handling and cleaning a heat exchanger tube bundle on site.

2. Description of the Prior Art

Heat exchanger tube bundles are used for the transfer of heat from a fluid median passing through a series of conduits. During this process, carbonaceous and calcareous deposits will form on the interior of the individual tubes and debris and other dirt will collect on the surface of the individual tubes. Therefore, in order to maintain efficient operation of the facility it is necessary to periodically remove the tube bundles and clean them.

The preferred way to clean a heat exchanger tube bundle is on location. However, this requires a mobile unit which is adapted to provide a high pressure cleaning system and other support facilities. An example of such a unit is disclosed and claimed in U.S. Pat. No. 4,805,653 to Krajicek et al. Essentially, Krajicek discloses a mobile tube cleaning device which uses a water discharge system to provide point source cleaning of a tube bundle or to support a multi-lance tube cleaning system. However, the Krajicek disclosure has a number of significant limitations, such as the inability to provide support to a tube bundle and coordinate the tube bundle's cleaning with the operation of the mobile cleaning system.

Therefore, the need exists for an improved tube bundle cleaner which is capable of manipulating and cleaning a heat exchanger tube bundle in such a manner that it is thoroughly cleaned on-site of all deposits and debris along its entire length in an efficient and thorough manner. While there are other disclosures directed to the cleaning of heat exchanger bundles (such as U.S. Pat. No. 3,938,535 and 4,095,305), none disclose or suggest an integral, mobile device which is capable of efficiently handling and cleaning an entire tube bundle.

SUMMARY OF THE INVENTION

Briefly, the invention relates to an apparatus for cleaning tube bundles which comprises two mobile base units. The first mobile base includes the water reservoir and pumping equipment. The second mobile base, which may be a trailer that accompanies the first mobile base, includes longitudinal support members which act as tracks and support frames for an articulable crane. The crane is adapted to move along the length of the second mobile base and is supplied high pressure water from the water reservoir through a pump assembly. Furthermore, the present invention includes means for stabilizing the second mobile base and for providing support for a heat exchanger tube bundle which is placed substantially parallel with the longitudinal axis of the second mobile base. The stabilizing/support means also includes means for rotating the tube bundle once it is supported on the stabilizing/support means. Thus, the tube bundle may be rotated and easily cleaned by the crane as the crane moves along the longitudinal axis of the second mobile base.

The stabilizing/support means comprises outriggers which are attached to the sides of the second mobile base. Once extended, the outriggers provide support for a box frame structure which is placed on top of each outrigger. The mechanism for rotating the tube bundles is preferably supported within the frame structure.

Examples of the more important features of this invention have been summarized rather broadly in order that the detailed description may be better understood. There are, of course, additional features of the invention which will be described hereafter and which will also form the subject of the claims appended hereto.

BRIEF DESCRIPTION OF THE DRAWINGS

In order to more fully understand the drawings used in the detailed description of the present invention, a brief description of each drawing is provided.

DETAILED DESCRIPTION OF THE INVENTION

Figure 1:
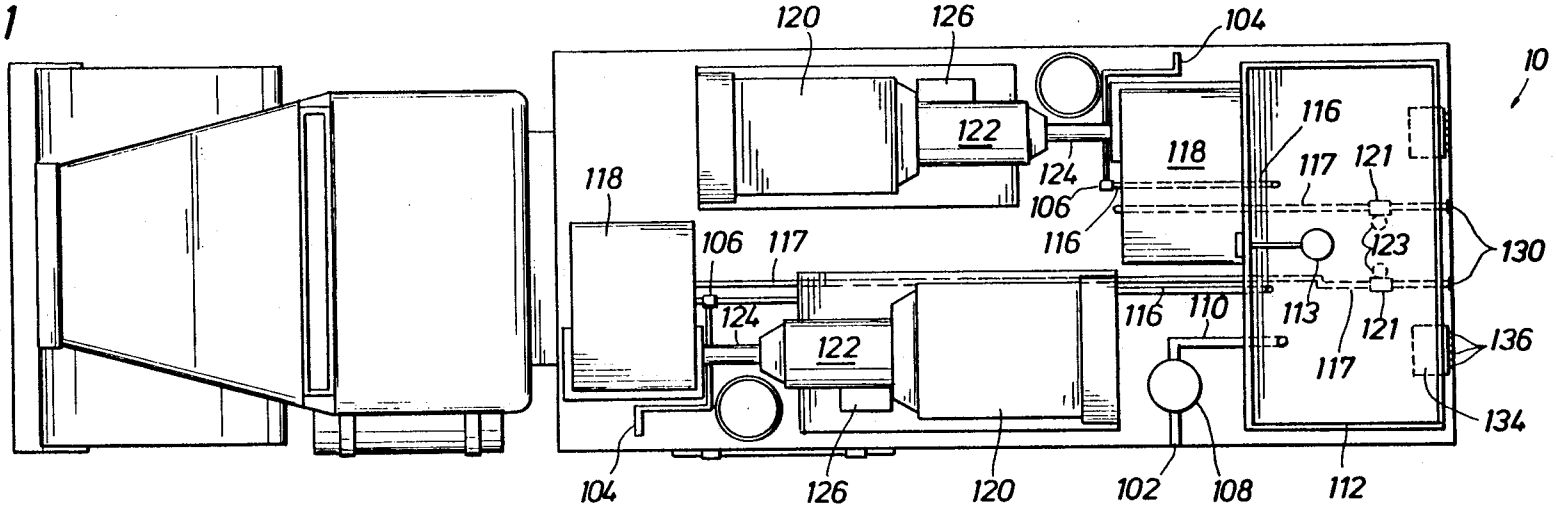
FIG. 1 is a top view of the first mobile base.
Figure 2:
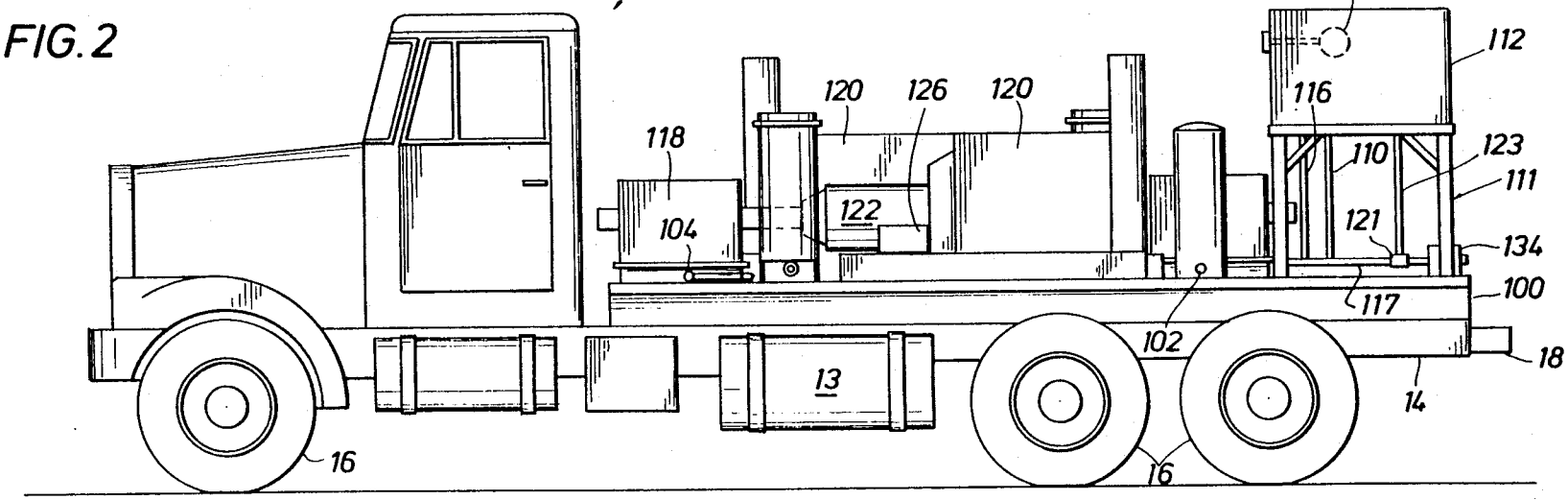
FIG. 2 is a side view of the first mobile base.

Referring to FIGS. 1 and 2, top and side views of a first mobile base 10 are shown. The mobile base 10 is mounted on a suitably constructed skid 100 and may be transported to a job site by various means. In the preferred embodiment, the skid 100 is mounted on a conventional truck 12 by mating skid 100 with the truck chassis 14. In FIG. 1, the truck 12 of the preferred embodiment is a conventional ten-wheel, multi-axle, diesel powered truck. The truck chassis 14 includes a trailer hitch 18 affixed to and positioned at the central rear of the truck chassis 14. Further, a fuel tank 13 is adapted to be mounted on the truck 12 to provide fuel for the water pressurizing systems discussed below. The truck is used to transport the first mobile base and tow a trailer which may be used for support equipment, including a second mobile base 20 as shown in FIGS. 3–6 and described below, to a job site. However, it should be noted that the second mobile base as shown in FIGS. 3–6 may be transported to a job site independent of the first mobile base 10.

The first mobile base 10 includes a system for providing high pressure water to clean the tube bundles. The water pressure required to effectively clean the tube bundles of carbonaceous and calcareous deposits is in the range of 10,000 psi at flow rates as high as 100 gallons per minute. Accordingly, the first mobile base 10 must be capable of providing water at both high pressure and flow rates for a sustained period of time.

The first mobile base 10 includes two independent water pressuring systems. Each system comprises an engine 120, transmission 122, shaft drive 124, and pump 118. The present invention is adapted to connect with a conventional water supply source which may be found at a job site, such as a fire hydrant. A first interconnection 102 is provided to be connected to a water supply, such as a fire hydrant, which provides water at pressures approaching 100 p.s.i. A second water interconnection 104 is also provided to receive water at a lower pressure rate, on the order of 40 p.s.i. The second interconnection 104 is directly interconnected to the pump 118. The second water interconnection 104 is used when cleaning operations call for the capture, recovery and re-use of water and/or cleaning solvent used in cleaning the tube bundles. The water is recovered by means of a separate recovery pump (not shown) interconnected to the second water interconnection 104. Check valve 106 prevents water supplied through the main water supply system from flowing back out through water interconnection 104.

The water supplied through water interconnection 102 enters a commercial water filtering system 108 of conventional design, such as that available through Water Technology Equipment Co., Model No. WB21M. The water flows through feed pipe 110 into a water reservoir 112 supported by bracket assembly 111 on skid 100. The reservoir 112 is open to the atmosphere and includes a level float 113. When the level f)oat detects that the water in the reservoir 112 has reached a predetermined level, the float 113 actuates a cut-off valve (not shown) shutting off water entering the system through water interconnections 102 and 104. As the water level drops in reservoir 112, float 113 lowers, opening the water cut-off valve, thus permitting water to flow through the filter 108, feed pipe 110 and into reservoir 112. Water is then supplied to the water pressuring system through piping 116. It is understood that the present invention may be used with other fluids in place of or in addition to water, such as cleaning fluids or other cleaning agents in solution with water or by themselves. Accordingly, it is understood that any further references to water is intended to include the use of water, cleaning agents or any soluble combination thereof.

The present invention contemplates two independent water pressurizing systems and hydraulic pressurizing systems. Accordingly, any reference to components within one pressurizing system is meant to refer to the other pressurizing system as well unless otherwise specified. In order to provide high pressure water at relatively high flow volumes, the preferred embodiment of the present invention contemplates the use of two high volume, high pressure, positive displacement pumps 118 mounted on skid 100. Water is supplied to the suction side of pump 118 by means of piping 116. The pump 118 may be driven by any suitable power transmission means. In the present embodiment, the pump 118 is driven by means of a suitable turbo-diesel engine 120 driving transmission 122 and shaft 124 connected to pump 118. The high pressure water output from pump 118 is piped to the rear of the skid 100 via high pressure water line 117 to outlet 130. Thus, the preferred embodiment includes two independent water pressurizing systems each including a pump 118, engine 120, transmission 122, shaft drive 124 and outlet connection 130. The present invention also contemplates the operation of a single water pressuring means when sustained volumes and pressures do not require the use of both water pressurizing means.

It is contemplated that high pressure water will not be required continuously during tube bundle cleaning operations. However, it is not desirable that the high pressure water system maintain high pressure levels when water is not required, as it could result in damage to both the pump 118 and the transmission 122 as well as high pressure water line 117. To prevent this, the present invention includes a commercial control valve 121, such as a Model CWD 15,000–2 inch; manufactured by the Weco Valve Co. Valve 121 is placed in the high pressure water line 117 upstream of the outlet 130. When the control valve 121 detects no demand for high pressure water at outlet 130, the control valve 121 sends a signal which will automatically idle engines 124, thereby placing pumps 118 in an idle load state. The control valve 121 will then shunt water at reduced pressure back to the water reservoir 113 through water lines 123. Thus, the present invention includes a means for automatically placing the pumps 118 and engines 120 in an idle state and recirculating water in the absence of a high pressure water demand.

Figure 7:
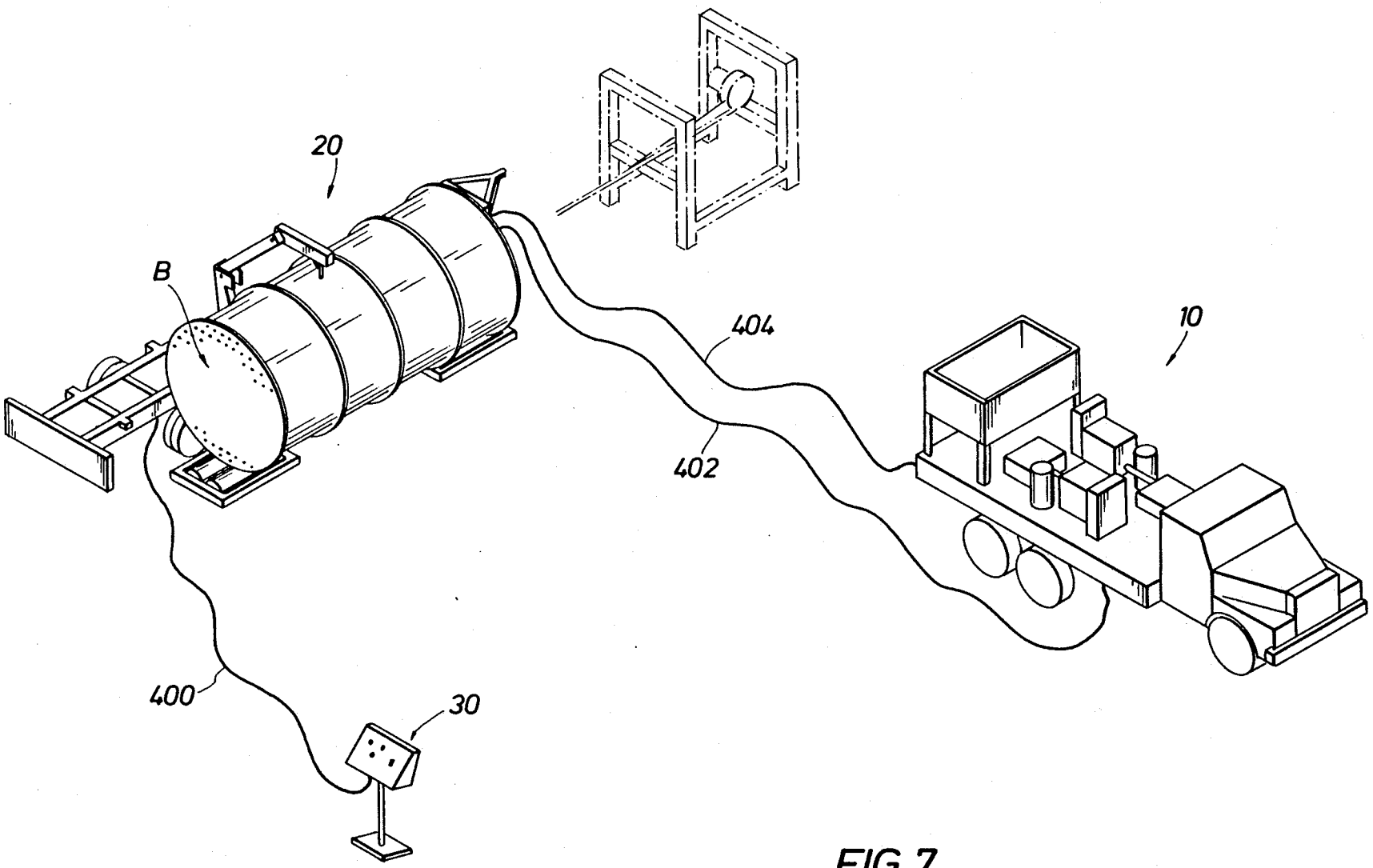
FIG. 7 is a perspective view of the first mobile base, second mobile base and remote operator console.

Also included as part of the first mobile base 10 is a hydraulic pressure source. In the preferred embodiment, a hydraulic pump 126 is attached to the transmission 122. A suitable commercially available variable displacement hydraulic pump is Model No. PVW101SAYCE available from the Oil Gear Co. The hydraulic pump 126 output is in fluid communication with a hydraulic manifold 134 having a plurality of outlets 136. Further, the valves and controls incorporated in hydraulic manifold 134 and outlets 136 and accompanying valves are controlled by means of a single remote control pedestal 30 as shown in FIG. 7. The remote control pedestal 30 is in electrical communication with commercially available control valves (not shown) in connections 130 and manifold 134 and engines 120 by means of a control umbilical 400. Thus, the control pedestal 30 may be located a distance from the first mobile unit 10. Further, the control pedestal 30 and umbilical 400 are adapted to be mounted and secured on skid 100, thus providing a means of transporting the control pedestal 30 and umbilical 400 to the job site.

Figure 3:
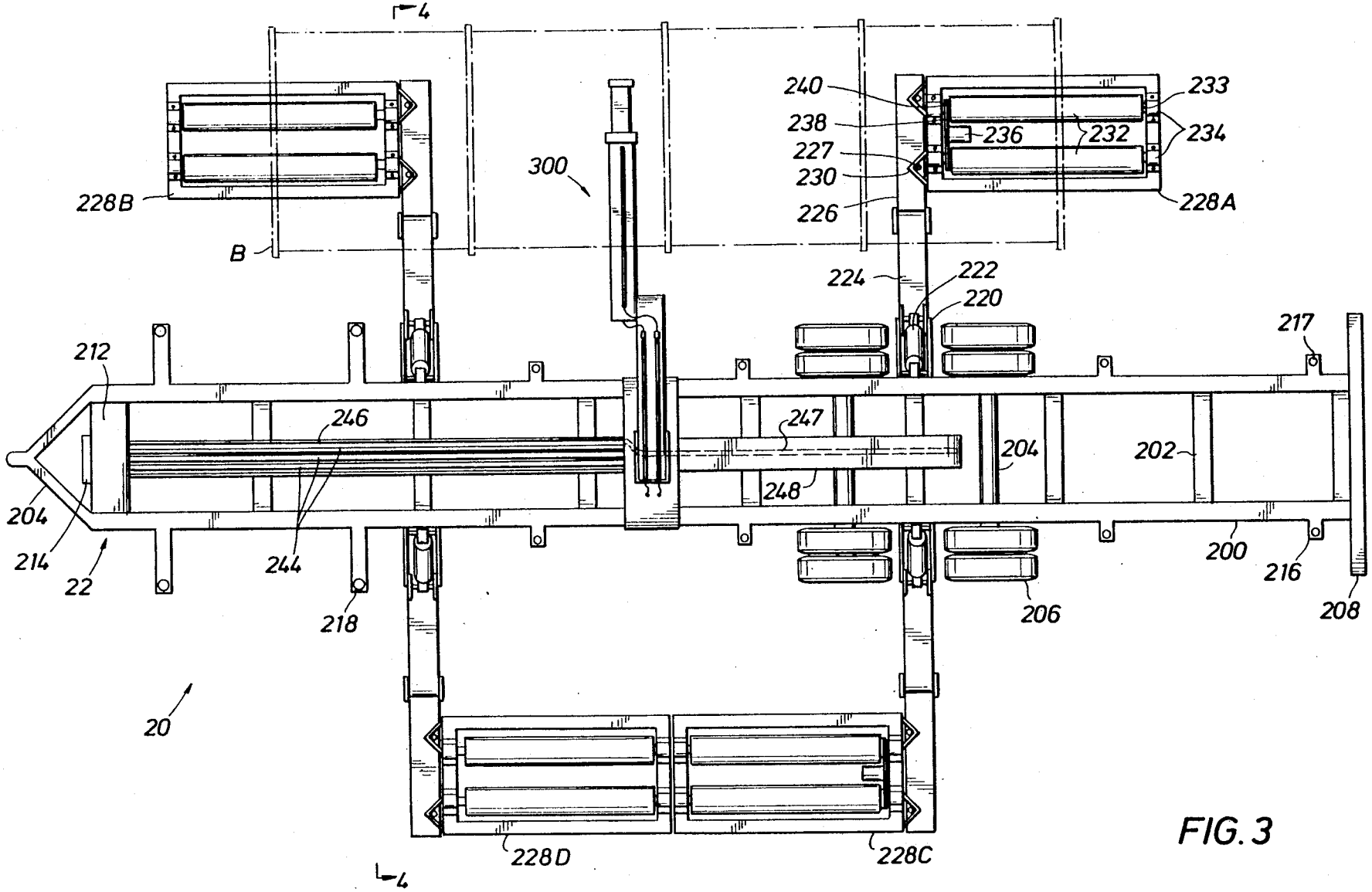
FIG. 3 is a top view of the second mobile base.

Referring to FIG. 3, a second mobile base 20 is shown, which includes an articulable crane 300 and a system 203 for stabilizing the second mobile base and for supporting and rotating the tube bundle "B" to be cleaned. The second mobile base 20 may be any suitably constructed transportable platform capable of supporting the articulable crane 300 and the stabilizing and tube bundle support system 203, such as a traditional 35 to 50 foot flatbed trailer. In the preferred embodiment, the second mobile base is configured as a multi-axle frame trailer generally of I-beam construction.

Referring still to FIG. 3, a trailer 22 is shown constructed of two I-beams 200 which are substantially parallel to the longitudinal axis of the trailer 22. A plurality of smaller cross beams 202 are inserted between and attached to I-beams 200 to provide strength and prevent movement of I-beams 200. In the preferred embodiment, the cross beams 202 are welded into place between I-beams 200 using conventional welding techniques. The trailer 22 includes two axles 204, each axle having four suitable wheels/tires 206. The trailer 22 also includes a bumper 208 and conventional towing frame 204 attached to I-beams 200 at opposite ends. Thus, the trailer 22 may be transported to a job site by the truck 12 supporting the first mobile base or another tractor.

Trailer 22 also includes a crownpiece 212 located distally from bumper 208 and attached to I-beams 200. A manifold 214 is mounted on the front face of crownpiece 212 and is adapted to receive both high pressure water source and hydraulic pressure from a suitable source, such as hoses connected with the hydraulic manifold 134 and water pressure connections 130 of first mobile base 10. Trailer 22 has a plurality of storage attachment points 216, more clearly depicted in FIGS. 4–6, which may be used to store the tube bundle support and rotating equipment or other equipment. Equipment is secured to attachment points 216 by inserting a pin (not shown) through a hole 217 in the attachment point 216. The trailer 22 further includes a plurality of horizontal support beams points 218 which may be used to support other equipment.

Figure 4:
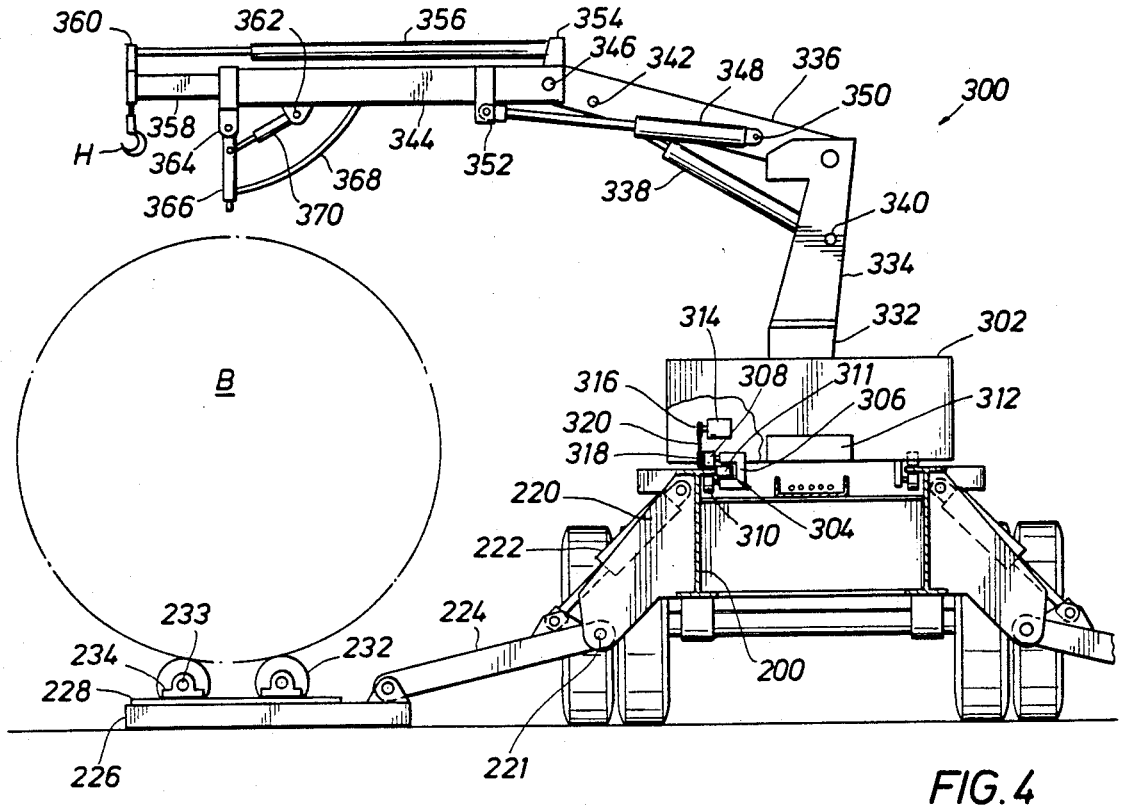
FIG. 4 is a partial end view of the second mobile base shown in FIG. 3.
Figure 5:
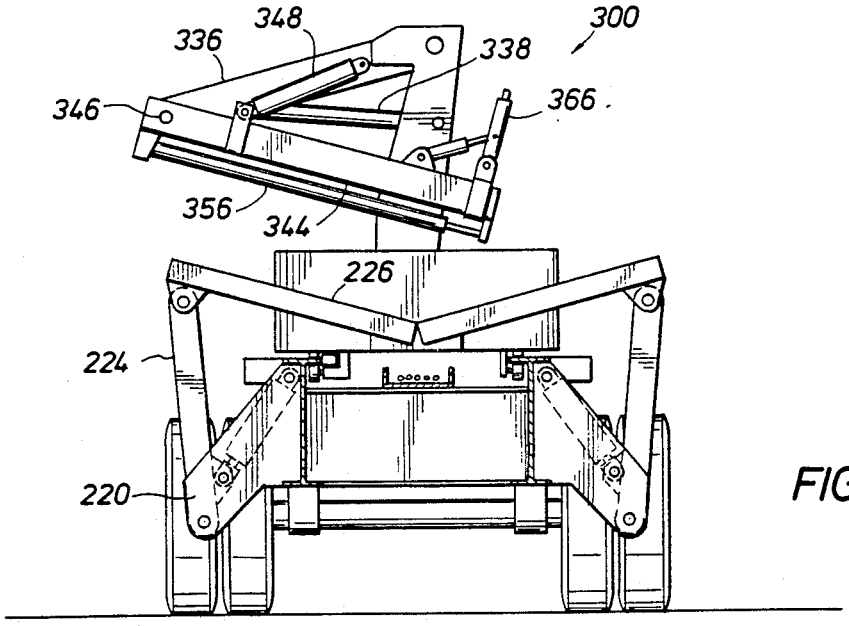
FIG. 5 is an end view of the second mobile base in a folded configuration for travel.

Referring now to FIGS. 3 and 4, attached to trailer 22 are four outrigger brackets 220. Each bracket 220 may be attached to the I-beam 200 by any suitable means and is welded to the I-beam 200 in the preferred embodiment. A hydraulic cylinder 222 is pivotally attached to the outrigger bracket in proximity to I-beam 200 and is in fluid communication with manifold 214. An outrigger arm 224 is attached to outrigger bracket 220 and is pivotally attached to the bracket 220 at pin connection 221. Further, the outrigger arm 224 is pivotally attached to hydraulic cylinder 222 at a point on the arm 224 below pin connection 221. Thus, the outrigger arm 224 may be raised, as shown in FIG. 5, or lowered, as shown in FIG. 4, by applying hydraulic fluid pressure to hydraulic cylinder 222. An outrigger pad 226 is pivotally attached to the distal end of outrigger arm 224. The outrigger pad 226 provides additional stability when outrigger arm 224 is lowered. As shown in FIG. 5, the outrigger pad 226 is pivoted to a closed position when outrigger arm 224 is retracted. The pad 226 may be rotated to the retracted position shown in FIG. 5 by manual lifting.

Figure 6:
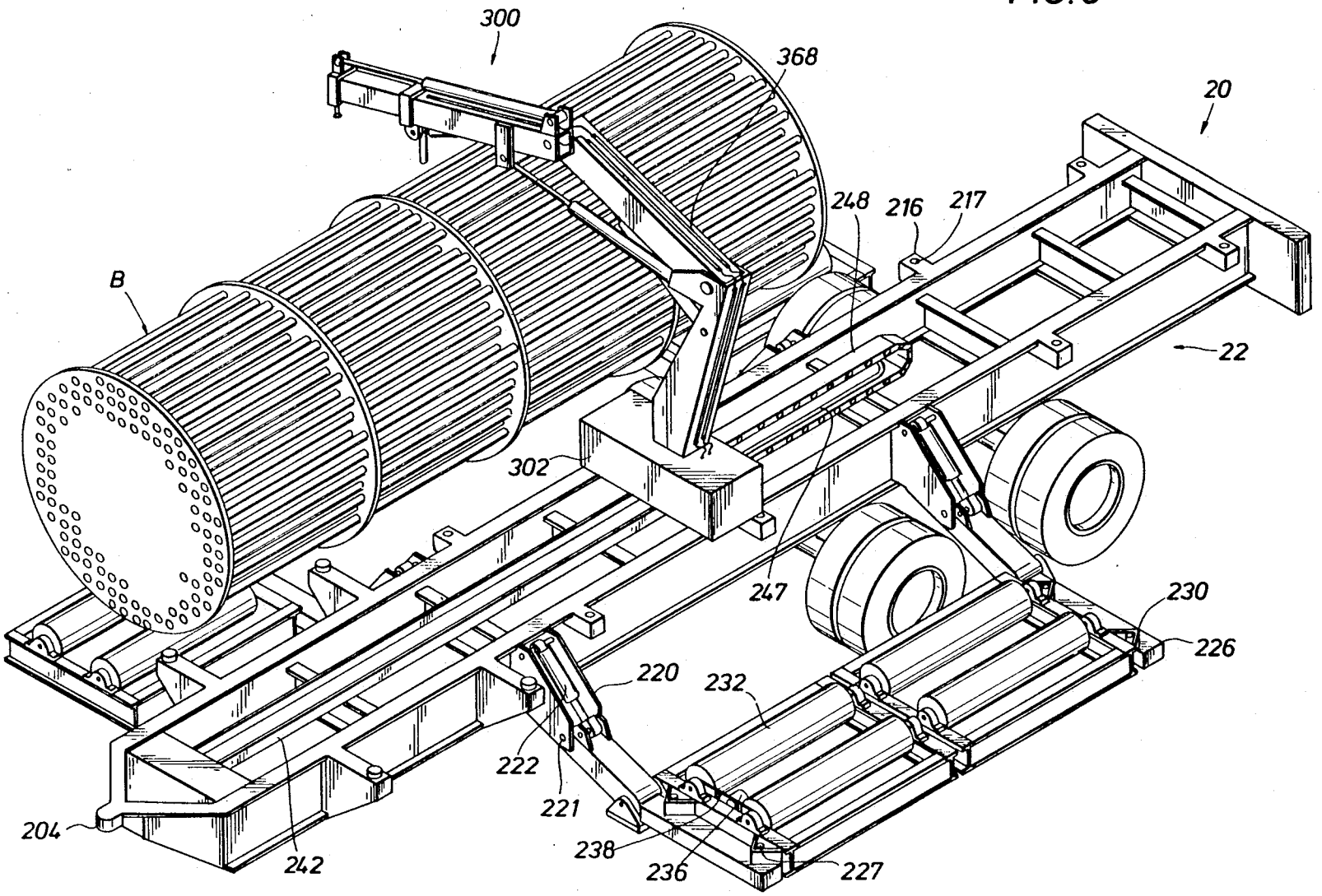
FIG. 6 is a perspective view of the second mobile base.

In FIG. 3, the tube bundle support and rotating system is shown as selectively connected to outrigger pads 226. In the preferred embodiment, there are four tube bundle support and rotating systems 228A–D. References to any one of the tube bundle support/rotating systems may be understood to be a reference to all tube bundle support/rotating systems unless otherwise specified. A suitable rectangular frame 228 is shown which may be manufactured utilizing I-beam or box channel material or other material of suitable cross-sectional configuration. In the preferred embodiment, the frame 228 is manufactured from welded box channel. The frame 228 includes two sets of vertical plates 230 which are adapted to mate with and attach to outrigger pads 226. Preferably, the plates 230 may be attached to the outrigger pads 226 by means of latches, nuts and bolts or other suitable mechanical means. Referring now also to FIG. 6, in the preferred embodiment the pads 226 and plates 230 each have aligning holes therein and an aligning pin 227 is inserted into the aligned holes. Within each frame 228 are two cylindrical and substantially parallel rollers 232. The rollers 232 are aligned and retained within the frame 228 by means of bearing blocks 234 which retain roller shafts 233 and are located at the distal end of each roller 232 and affixed to frame 228. Accordingly, the rollers 232 are disposed substantially parallel to the longitudinal axis of the trailer 22. Mounted on the frame 228 between the rollers 232 is a hydraulic motor 236 which is in fluid communication with manifold 214. Motor 236 is also in rotational communication with rollers 232 within frame 228. In the preferred embodiment, motor 236 has a sprocket drive output (not shown) which is interlinked to endless drive chain 238. The drive chain 238 is itself in communication with rollers 232 by means of drive gears 240 mounted between rollers 232. Thus, the rotational motion created by hydraulic motor 236 is imparted to rollers 232 causing rollers 232 within frame 228 to rotate in a like direction when the hydraulic motor 236 is activated.

As will be noted in FIGS. 3 and 6, the frames 228 and equipment thereon may be mounted outboard of pads 226, as shown by frames 228A and 228B, or inboard of pads 226 as shown by frames 228C and 228D. It is contemplated that only one frame per pair, for example, frames 228A and 228C include hydraulic motor 236. The remaining frames 228B and 228D are non-powered and operate as idler rollers. Further, the remote console 30 (see FIG. 7) is capable of reversing the control valves within hydraulic manifold 128 such that the hydraulic motors 236 for frame pairs 228A/B and 228C/D may be energized to selectively rotate the rollers 232 in a clockwise or counter-clockwise direction.

The misalignment of support rollers 232 (for example, those mounted within frames 228A and 228B) can result in the tube bundle "B" walking off the support rollers 232 resulting in increased effort during cleaning operations and potential damage to the tube bundle "B." In the present invention, the mounting of the frames 228 on outrigger pads 226 ensures that the frames 228 A/B and 228 C/D are mounted substantially parallel to the trailer 22 and, consequently, to each other. The present invention thus provides for the accurate alignment of rollers thereby preventing the tube bundle "B" from walking off rollers 232.

Referring still to FIG. 3, a plurality of hydraulic lines 244 and a high pressure water line 246 are in fluid communication with manifold 214 and extend to a point approximately midway down the length of trailer 22. The hydraulic lines 244 are made of a suitable commercially available flexible high pressure hydraulic hose. The high pressure water line 246 is manufactured from commercially available high pressure pipe. The water line 246 is further connected to a commercially available high pressure water hose 247 at the end distal from crownpiece 212. The hydraulic lines 244 and water line 247 are supported by a flexible drag chain 248 attached to trailer 22 at approximately the mid point of trailer 22, the distal end of the drag chain 248 being attached generally to the crane assembly 300. The drag chain 248 provides a flexible means of protection for hydraulic lines 244 and water line 247 during operations while insuring that the lines are not overly stressed while the crane assembly is in operation.

FIG. 4 is a partial end view of the second mobile base 20 illustrating articulable crane 300 in greater detail. Articulable crane 300 may be any hydraulic powered extendable boom crane having the necessary degrees of freedom. In the preferred embodiment, the crane suggested for use is a HIAB 070 extendable boom crane sold by HIAB - TIFFIN Loader Crane Co., of Tiffin, Ohio.

Crane 300 includes a crane base 302 of generally inverted open box form. Within base 302 are a plurality of guide wheel sets 304, rotationally mounted on a guide wheel bracket 306, which is itself affixed to base 302. An upper wheel 308 of the guide wheel set 304 is adjacent to and in contact with the upper surface of the interior flange of I-beam 200 and a lower wheel 310 is positioned opposite upper wheel 308 below the interior flange of I-beam 200. Thus, the base 302 is free to roll up and down the length of trailer 22 along I-beam 200. The guide wheel set 304 further includes a horizontal guide wheel 311 rotationally mounted on bracket 306. The horizontal guide wheel 311 is in contact with the internal edge of the top flange of I-beam 200. Thus, the crane base 302 is horizontally or laterally stabilized. A manifold 312 is attached to crane base 302 and is in fluid communication with hydraulic lines 244 and water line 246. The manifold 312 also includes commercially available control valves (not shown) which are used in their normal and intended manner to control hydraulic fluid. A hydraulic drive motor 314 is mounted in proximity to each guide wheel set. The drive motor 314 is in fluid communication with the manifold 312 and hydraulic lines 244 attach thereto. The output of drive motor 314 is transmitted to a drive sprocket 316. A like drive sprocket 318 is affixed to the shaft of upper wheel 308 in drive wheel set 304 and sprockets 316 and 318 are in mechanical communication with each other by means of drive chain 320. Thus, rotational movement generated by drive motor 314 is transmitted to guide wheel 308, moving crane 300 along the length of I-beam 200 in response to selected hydraulic fluid flow direction and rate.

Still referring to FIG. 4, mounted on crane base 302 is a hydraulic, articulable, extendable boom crane assembly. For the purpose of simplicity, the hydraulic control lines and valves used to control crane 300 are not generally shown, except to note that they are attached to the exterior of the boom. The use of valves and lines to control a crane such as the HIAB 070 are generally known in the art and are preinstalled on the HIAB 070. A crane pedestal 332 is mounted on crane base 302 by suitable mechanical means which will permit maintenance of the crane 300 and provide sufficient anchoring strength during the crane's operations. In close proximity to and rotational communication with crane pedestal 332 is a first arm 334. The first arm 334 may be selectively rotated 360 degrees about the central axis of crane pedestal 332 by means of application of hydraulic pressure. The crane pedestal 332 and first arm 334 are in fluid communication with manifold 312. A second arm 336 is pivotally connected to first crane arm 334 at the distal end of crane arm 334. A first crane hydraulic cylinder 338 is pivotally attached to first crane arm 334 at pivot 340. The second end of the first hydraulic cylinder 338 is attached to the second crane arm 336 at pivot 342. Further, the first hydraulic cylinder 338 is in fluid communication with manifold 312. Accordingly, the selective application of hydraulic pressure to the first hydraulic cylinder 338 will cause the second crane arm 336 to rotate in a vertical plane about pivot 340 on the first crane arm 334. A third crane arm 344 is pivotally attached to the distal end of the second crane arm 336 at pivot 346. The third crane arm 344 is manufactured as a hollow box channel. A second hydraulic cylinder 348 is pivotally attached to the second crane arm 336 at pivot 350. The other end of the second hydraulic cylinder 348 is pivotally attached to a bracket 352 affixed to the third crane arm 344. The bracket 352 may be attached in a suitable conventional manner such as welding, or through the use of nuts and bolts. The second hydraulic cylinder 348 is in fluid communication with the manifold 312. Accordingly, selective application of hydraulic pressure to the second hydraulic cylinder 348 will move the third cylinder arm about pivot 346. A bracket 354 is affixed to the third crane arm 344, and a third hydraulic cylinder 356 is affixed to the bracket 354. An extendable boom 358 is mounted within third crane arm 344. The boom 358 is supported within third crane arm 344 in a suitable manner. The second end of hydraulic cylinder 356 is attached to a bracket 360 mounted on the end of the third crane arm 344. The hydraulic cylinder 356 is in fluid communication with the manifold 312. Thus, the boom 358 may be moved within the third crane arm 344 by means of selective application of hydraulic pressure to hydraulic cylinder 356. A hook "H" may be removably attached to the boom 358 to permit the crane assembly 330 to be used to lift equipment, such as frames 228 or other loads.

The crane assembly also includes an articulable system for directing a high pressure stream of water onto the tube bundle "B". Brackets 362 and 364 are affixed to the underside of the third crane arm 344. Pivotally attached to bracket 364 is a high pressure water nozzle 366, which is supplied high pressure water through a water line 368 (see FIG. 6) which is attached to the exterior of the crane assembly and is itself in fluid communication with water line 246. A hydraulic cylinder 370 which is in fluid communication with manifold 314 is pivotally attached to bracket 362. The distal end of cylinder 370 is pivotally attached to water nozzle 366. Accordingly, the angle of incidence at which the water stream strikes a tube bundle "B" may be varied through selective application of hydraulic pressure to cylinder 370 or selective movement and orientation of all three arms 334, 336 and 344 relative to tube bundle "B".

Tube bundle "B" may be rotated by means of frames 228 and the rollers 232 and hydraulic motors 236 mounted thereon. The rate of movement of the crane base 302 and rollers 232 may be controlled by an operator from the remote control pedestal 30. Further, the movement of the crane arms and the nozzle may be controlled from the pedestal 30 using hydraulic flow controls generally known in the art. Thus, the present invention is capable of maintaining a constant angle of incidence as the crane base 302 moves parallel to tube bundle "B. " In prior art devices, such as the Krajicek disclosure, the crane was required to move in a rotational arc in order to clean the length of the tube bundle. In order to maintain a constant angle of incidence, the operators had to constantly adjust the nozzle direction. However, in the present invention the angles and other adjustments of the top of the nozzle are set for each pass and may be located close to the far side of the bundle, if necessary, for superior cleaning.

FIG. 5 is an end view of the second mobile base depicting the outrigger arms 224 and pads 226 in a retracted position ready for travel. It should be noted that the frames 228 used to support the tube bundle positioning and rotating equipment have been removed from the outrigger pads 226. The frames 228 may be stored on the trailer 22 at storage attachment points 216 and pinned and secured onto the trailer. It is contemplated that the crane 300 is used to transport the frames 228 to their storage position on the trailer 22 and to deploy the frames 228 during cleaning operations. In FIG. 5, the crane 300 is depicted in its transport position.

FIG. 6 is a perspective view of the second mobile base illustrating shell side tube bundle cleaning operations. By that it is meant that the exterior of the bundle is cleaned by the side of the bundle's shell or on site. Similarly, tube side (or interior tubular) cleaning of the bundles may be preformed using a multilance assembly as disclosed and claimed in co-pending U.S. patent application Ser. No. 490,776 as shown in phantom in FIG. 7. As discussed in co-pending U.S. patent application 490,776, the multi-lance cleaning assembly requires a high pressure hydraulic and water system. One of the two independent water and hydraulic pressurizing systems of the present invention can be used to provide hydraulic and water pressure to the multi-lance while the other independent system can be used to provide water and hydraulic pressure to the second mobile base 20 as set forth above.

High pressure water line 368 is shown as rising out of crane base 302 and affixed to crane arms 334, 336, and 344. It is contemplated within the present invention that water line 368 is of sufficient strength and length to permit full movement of the crane assembly and nozzle 366 during cleaning operations. The tube bundle "B" is shown as being supported on rollers 232 within frames 228 which have been mounted outboard of stabilizer pads 226.

FIG. 7 is an perspective illustration of the present invention showing the first mobile base 10, second mobile base 20 and a remote control pedestal 30. The remote control pedestal 30 is shown as being in electrical communication with the second mobile base 20 through a low voltage electrical umbilical cable 400. The second mobile base is further shown as being in electrical communication with the first mobile base 10 through a second low voltage electrical umbilical cable 402. Further, the first mobile base is illustrated as being in fluid communication with the second mobile base through flexible tube bundle 404. The flexible tube bundle 404 includes high pressure water lines and various hydraulic lines as disclosed above which bridge connections 130 and manifold 134 of first mobile base 10 and manifold 214 of second mobile base 20. It is contemplated that the remote control pedestal 30 includes controls for the first mobile base 10, including engine speed controls and water flow valve controls to manage the flow of water to and from pumps 118. Further, it is contemplated that remote control pedestal 30 includes controls for various hydraulic systems on the second mobile base 20 such as the movement of crane 300, direction and rate of movement of the crane base 302, and rotation direction and rate of movement of rollers 232. An operator may thus control the entire range of operations during shell side bundle cleaning operations.

OPERATION OF THE PRESENT INVENTION

Due to the size and weight of a heat exchanger tube bundle, the tube bundle must generally be cleaned on site. Thus, the first and second mobile bases 10 and 20 are transported to the job site. In the preferred embodiment, the first mobile base 10 is transported to the job site by truck 12. The second mobile base 20 is transported to the job site on trailer 22. Trailer hitch 204 may be used to mate the trailer 22 to any suitable vehicle for transport to the job site.

It is contemplated that the tube bundle "B" will have been removed from its shell prior to or contemporaneous with the arrival of the first and second mobile bases 10 and 20 at the job site. The trailer 22 will be towed into proximity of the tube bundle "B." The truck 12 is then moved into proximity of the trailer 22. Flexible hydraulic lines 404 (FIG. 7) are then connected between hydraulic manifold 134 on skid 100 and manifold 214 located on the front of crownpiece 212 on trailer 22. The hydraulic lines may be stored on either the first or second mobile bases 10 and 20 during transport or may be transported to the job site by an auxiliary support vehicle.

One or more of the engines 120 on the first mobile base is started to provide hydraulic power through pump 126. With the availability of hydraulic power, outrigger arms 224 are lowered and outrigger pads 226 are unfolded and brought into contact with the ground, providing stability for the second mobile base. The crane assembly 300 is then activated to unload frames 228A-D from the trailer 22 and to bring them into mating contact with outrigger pads 226. Pins 227 are then inserted into the frame brackets 230 and outrigger pads, connecting and aligning the frames 228A-D. Flexible hydraulic lines are connected between the trailer 22 and hydraulic motors 236 mounted on frames 228A and 228C, thus providing hydraulic communication between trailer 22 and frame 228 motors 236.

The crane assembly 300 is then used to lower remote pedestal 30 to the desired operator position. The remote pedestal 30 is connected to the second mobile base 20 by means of a low voltage umbilical cable 400 (FIG. 7). A second low voltage umbilical cable 402 is used to interconnect controls on the first and second mobile bases 10 and 20. Thus, the operator may control operation of both the first and second mobile bases 10 and 20 from the remote control pedestal 30. The tube bundle "B" is then placed on frame pairs 228 A/B or 228 C/D, substantially parallel to trailer 22. The tube bundle "B" is thus ready to be cleaned.

Flexible water hoses (not shown) are used to connect water interconnection 102 to a suitable high volume water source. A high pressure flexible water line is used to interconnect outlet 130 with a similar connection on manifold 214. Thus, the first and second mobile bases 10 and 20 are in water communication with each other. As water lines 246 and 368 are also in water communication with each other, there now exists a conduit for high pressure water from the first mobile base 10 to the second mobile base 20 and to the water nozzle 366 mounted on third crane arm 344. The external water source is turned on and water flows through the first mobile base filter 108 and enters reservoir 112. The operator engages transmission 122 which drives shaft 124 and pump 118 at an idle state. Water flows out of the reservoir 112 through pipe 116 to the low pressure side of pump 118. The high pressure side of pump 118 is connected to outlet 130 by high pressure line 117. Valve 121 detects the lack of demand for high pressure water, decreases engine 120 speed and shunts the water from pump 118 high pressure side back into reservoir 112 through pipe 123, thus recirculating the water. Float 113 will activate a control valve which cuts off the water supply when the water level in reservoir 112 is at a desired level.

The operator positions the crane assembly 300 to achieve the desired angle of incidence for a high pressure stream of water and the crane 300 is then positioned at on end of tube bundle "B." The operator at remote pedestal 30 increases the engine speed and opens the valve at outlet 130 to permit the flow of water from the first mobile base 10 to the second mobile base 20 and crane 300. As the engine speed increases, the pump pressure and flow rate increases, thus pumping a high volume of water at pressures in excess of 10,000 psi. As the water is fed to the pump high pressure side from reservoir 112, the float 113 will detect the decrease in water level and open the control valve, thus permitting water to enter into the reservoir from the external water source through filter 108. The high pressure water exits nozzle 366 and strikes tube bundle "B" removing external deposits on the tube bundle. The operator may variably engage hydraulic motor 314 mounted within crane base 302 to cause the crane assembly to move the length of trailer 22, parallel to the tube bundle "B." The rate of movement of the crane assembly 300 is achieved by varying the hydraulic pressure to motor 314. Thus, the water stream exiting nozzle 366 maintains a constant angle of incidence with respect to the tube bundle down the entire length of the tube bundle. The operator may repeat the cleaning pass by engaging motor 314 in the opposite direction, causing the crane assembly to traverse the length of the tube bundle in the opposite direction. The operator may also vary the nozzle 366 angle of incidence to further improve cleaning operations. The frame 228 A/C motor 236 is then engaged to index tube bundle "B" to present another section of the tube bundle to be cleaned.

The present invention is also capable of recycling cleaning water. Water interconnection !04 is connected to a separate pump used to recover water already used during cleaning operations. The recycled water is fed back into the lower pressure supply line 116 through check valve 106, permitting use of water from both reservoir 112 and recycled water. Thus, the present invention is capable of utilizing fresh water feed through water interconnection 102.

The description given herein is intended to illustrate the preferred embodiment of the present invention. It is possible for one skilled in the art to make various changes to the details of the apparatus without departing from the spirit of this invention. Therefore, it is intended that all such variations be included within the scope of the present invention as claimed.

What is claimed is:

1. An apparatus for cleaning a heat exchanger tube bundle using fluids comprising:

a first mobile base having a water reservoir to store the fluids from an external fluids source;

means for pressurizing the fluids mounted on said first mobile base;

a second mobile base proximate said first mobile base, said second mobile base having a longitudinal axis and longitudinal edges;

an articulated crane supported on said second mobile base and adapted for movement along said longitudinal axis of said second mobile base and capable of discharging the fluids toward the tube bundle;

means for delivering the fluids from said pressurizing means to said crane;

means for discharging the fluids having conduit means extending from said delivery means, said discharge means being mounted on said crane and capable of discharging the fluids toward the tube bundle; and means for stabilizing said second mobile base and for supporting and rotating the tube bundle, the tube bundle being aligned substantially parallel to said longitudinal axis of said second mobile base.

2. The apparatus according to claim 1, further comprising a second means for pressurizing fluids, said second means mounted on said first mobile base.

3. The apparatus according to claim 1, wherein said stabilizing and support means comprises:

a plurality of outriggers pivotally attached to a longitudinal edge of said second mobile base, said outriggers each having a first and a second position and capable of rotating in a vertical plane, the outriggers contacting the ground surface when in said second position;

distal arms pivotally attached to said outriggers, said arms being in contact with the ground surface along the length of the arms when said outriggers are in said second position; and means for moving said outriggers from said first position to said second position.

4. The apparatus according to claim 3, wherein said means for moving said outriggers from said first position to said second position comprises:

a hydraulic cylinder having a first end and a second end, said first end pivotally attached to said second mobile base and said second end pivotally attached to said outrigger; and means for delivering hydraulic pressure to said hydraulic cylinder, thereby moving said outriggers form said first to said second position and back through the selective application of said hydraulic pressure.

5. The apparatus according to claim 3, wherein said stabilizing and supporting means comprises:

at least one box frame;

two cylindrical rollers rotationally mounted within said box frame, said cylindrical rollers being mounted substantially parallel to each other within said box frame, the tube bundle being supported by said cylindrical rollers; and means for rotating said cylindrical rollers within said box frame, thereby rotating the tube bundle.

6. The apparatus according to claim 8, wherein said fluid discharging means further includes means for rotating said discharging means in a vertical plane.

7. The apparatus according to claim 6, wherein said means for rotating said fluid discharging means comprises:

a fluid nozzle pivotally attached to said crane;

a hydraulic cylinder having a first end and a second end, said first end being pivotally attached to said crane and said second end being pivotally attached to said fluid nozzle; and means for connecting said hydraulic cylinder to said hydraulic pressure means, the selective application of hydraulic pressure to said hydraulic cylinder rotating said fluid nozzle in a vertical plane.

8. The apparatus for cleaning a heat exchanger tube bundle using fluids comprising:

a first mobile base having a fluids reservoir to store the fluids from an external fluids source;

a first means for pressurizing the fluids mounted on said first mobile base;

a second means for pressurizing the fluids mounted on said first mobile base proximate said first pressurizing means;

a second mobile base proximate said first mobile base, said second mobile base having a longitudinal axis;

a crane assembly supported on said second mobile base capable of movement along said longitudinal axis of said second mobile base and capable of discharging the fluids toward the tube bundle;

means for delivering the fluids from said first pressurizing means to said crane;

means, mounted on said crane assembly, for discharging the fluids, having conduit means extending from said delivery means capable of discharging the fluids toward the tube bundle;

means for stabilizing said second mobile base;

means for moving said crane along said longitudinal axis of said second mobile base; and means for supporting and rotating the tube bundle, the tube bundle being aligned substantially parallel to said longitudinal axis of said second mobile base.

9. The apparatus according to claim 8, wherein said first and said second fluid pressurizing means are connectable directly to an external fluids source.

10. The apparatus according to claim 8, wherein said fluids reservoir further includes a fluids filtering means.

11. The apparatus according to claim 8, wherein said first and said second fluid pressurizing means comprise:

a high volume, high pressure positive displacement fluid pump; and means for powering said pump.

12. The apparatus according to claim 11, wherein said means for powering said pump comprises:

an internal combustion engine having an output shaft; and a transmission coupled to said output shaft of said internal combustion engine, said transmission having an output shaft coupled to said pump thereby powering said pump.

13. The apparatus according to claim 1 or 8, wherein said first mobile base comprises a multiaxled wheeled truck.

14. The apparatus according to claim 1 or 8, wherein said second mobile base comprises a multiaxled wheeled trailer.

* * * * *

UNITED STATES PATENT AND TRADEMARK OFFICE

CERTIFICATE OF CORRECTION

PATENT NO. : 5,018,544

DATED : May 28, 1991

INVENTOR(S) : THOMAS B. BOISTURE, LARRY D. MCGREW, JAMES D. JEFFREY, ROBERT G. WETZEL, GENE P. LIVINGSTON

It is certified that error appears in the above-identified patent and that said Letters Patent is hereby corrected as shown below:

At column 3, line 18, delete "f)oat" and insert therefor -- float --.
At column 3, line 69, delete ";" and insert therefor -- , --.
At column 11, line 15, delete "!04" and insert therefor -- 104 --.

In claim 4, column 12, line 14, delete "form" and insert therefor -- from --.
In claim 6, column 12, line 27, delete "8" and insert therefor -- 1 --.
In claim 8, column 12, line 42, delete "The" and insert therefor -- An --.

Signed and Sealed this

Twenty-seventh Day of October, 1992

*Attest:*

DOUGLAS B. COMER

*Attesting Officer*

*Acting Commissioner of Patents and Trademarks*